US006874391B2

(12) United States Patent
Hsien

(10) Patent No.: US 6,874,391 B2
(45) Date of Patent: Apr. 5, 2005

(54) ONE-WAY RATCHET WRENCH

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/613,844

(22) Filed: Jul. 1, 2003

(65) Prior Publication Data

US 2005/0000325 A1 Jan. 6, 2005

(51) Int. Cl.[7] ..... B25B 13/46
(52) U.S. Cl. ..... 81/60
(58) Field of Search ..... 81/60–63.2

(56) References Cited

U.S. PATENT DOCUMENTS 5,233,891 A * 8/1993 Arnold et al. ..... 81/60
5,979,274 A * 11/1999 Hsieh ..... 81/60
6,151,993 A * 11/2000 Shiao ..... 81/60
6,257,096 B1 * 7/2001 Ling ..... 81/60
6,467,378 B1 * 10/2002 Chen ..... 81/60
6,481,315 B1 * 11/2002 Chang et al. ..... 81/60
6,575,059 B2 * 6/2003 Liu ..... 81/60
6,591,717 B2 * 7/2003 Wei ..... 81/60
6,591,718 B1 * 7/2003 Chang ..... 81/60
6,745,647 B2 * 6/2004 Wang ..... 81/60
6,748,824 B2 * 6/2004 Chen ..... 81/60
6,748,825 B2 * 6/2004 Hsu ..... 81/60
2002/0162423 A1 * 11/2002 Hu ..... 81/60
2002/0162424 A1 * 11/2002 Hu ..... 81/60

FOREIGN PATENT DOCUMENTS

DE 3322967 A1 * 1/1985

* cited by examiner

*Primary Examiner*—David B. Thomas

(57) ABSTRACT

A one-way ratchet wrench includes a wrench body, a ratchet wheel, an elastic member, and a pawl member. Thus, the elastic member limits transverse and longitudinal movement of the locking portion of the pawl member, so that the pawl member is positioned rigidly and stably. In addition, the locking portion of the pawl member is rested on a side of the elastic member, thereby preventing the elastic member from producing fatigue.

15 Claims, 6 Drawing Sheets

ONE-WAY RATCHET WRENCH

BACKGROUND OF THE INVENTION

1. Field of the Invention

The present invention relates to a one-way ratchet wrench, and more particularly to a one-way ratchet wrench, wherein the elastic member co-operates with the pawl member rigidly and stably.

2. Description of the Related Art

A conventional one-way ratchet wrench in accordance with the prior art comprises a wrench body, a ratchet wheel, a spring, and a pawl member. The wrench body has a driving head formed with a mounting hole and a receiving recess. The ratchet wheel is rotatably mounted in the mounting hole of the wrench body and has an outer wall provided with a plurality of ratchet teeth. The pawl member is pivotally mounted in the receiving recess of the wrench body has a first side provided with a plurality of driving teeth meshing with the ratchet teeth of the ratchet wheel. The spring is mounted in the receiving recess of the wrench body and is urged between a second side of the pawl member and a wall of the receiving recess of the wrench body. However, the spring is constantly urged between the pawl member and the wall of the receiving recess of the wrench body, thereby easily producing fatigue during a long-term utilization.

SUMMARY OF THE INVENTION

The primary objective of the present invention is to provide a one-way ratchet wrench, wherein the elastic member co-operates with the pawl member rigidly and stably.

Another objective of the present invention is to provide a one-way ratchet wrench, wherein the elastic member limits transverse and longitudinal movement of the locking portion of the pawl member, so that the pawl member is positioned rigidly and stably.

A further objective of the present invention is to provide a one-way ratchet wrench, wherein the elastic member is closely combined with the pawl member, thereby preventing the elastic member from producing fatigue.

A further objective of the present invention is to provide a one-way ratchet wrench, wherein the locking portion of the pawl member is rested on a side of the elastic member, thereby preventing the elastic member from producing fatigue.

In accordance with the present invention, there is provided a one-way ratchet wrench, comprising a wrench body, a ratchet wheel, an elastic member, and a pawl member, wherein:

- the wrench body has a distal end provided with a driving head formed with a mounting hole and a receiving recess, the receiving recess of the wrench body has a wall;
- the ratchet wheel is rotatably mounted in the mounting hole of the wrench body;
- the elastic member is mounted in the receiving recess of the wrench body;
- the pawl member is pivotally mounted in the receiving recess of the wrench body and has a first side engaged with the ratchet wheel and a second side rested on the wall of the receiving recess of the wrench body; and
- the pawl member has an end provided with a locking portion extended outward and secured on a side of the elastic member.

Further benefits and advantages of the present invention will become apparent after a careful reading of the detailed description with appropriate reference to the accompanying drawings.

DETAILED DESCRIPTION OF THE INVENTION

Figure 1:
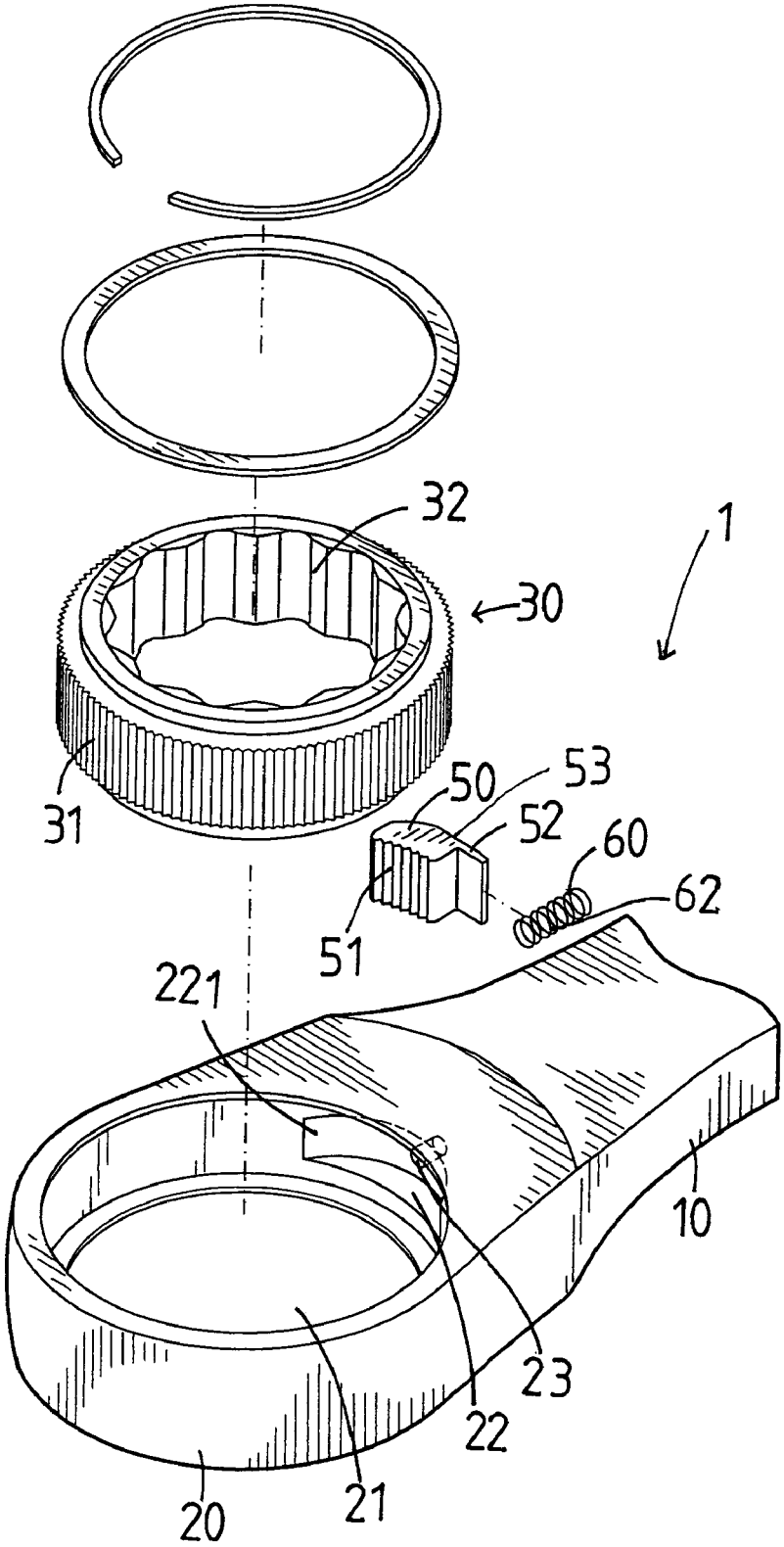
FIG. 1 is a partially cut-away exploded perspective view of a one-way ratchet wrench in accordance with the preferred embodiment of the present invention.
Figure 2:
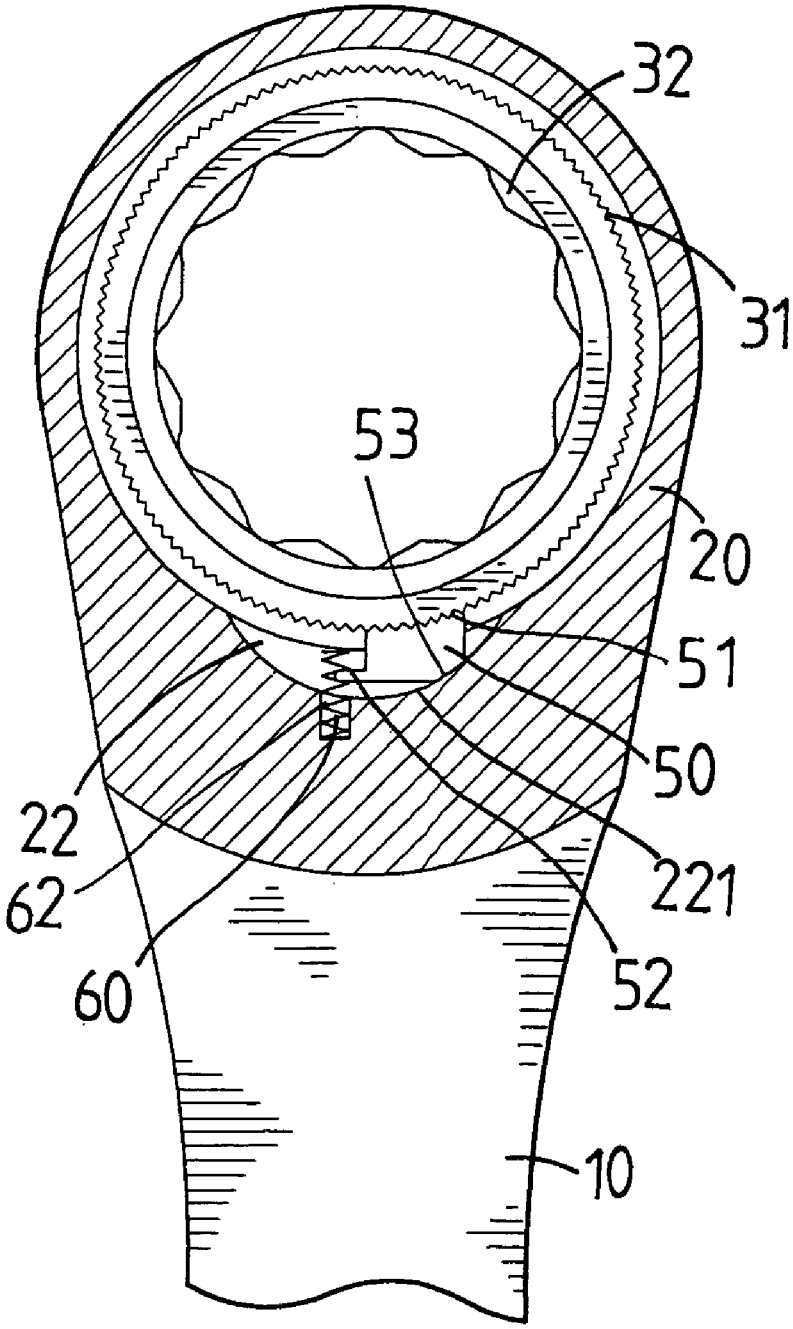
FIG. 2 is a top plan cross-sectional assembly view of the one-way ratchet wrench as shown in FIG. 1.
Figure 3:
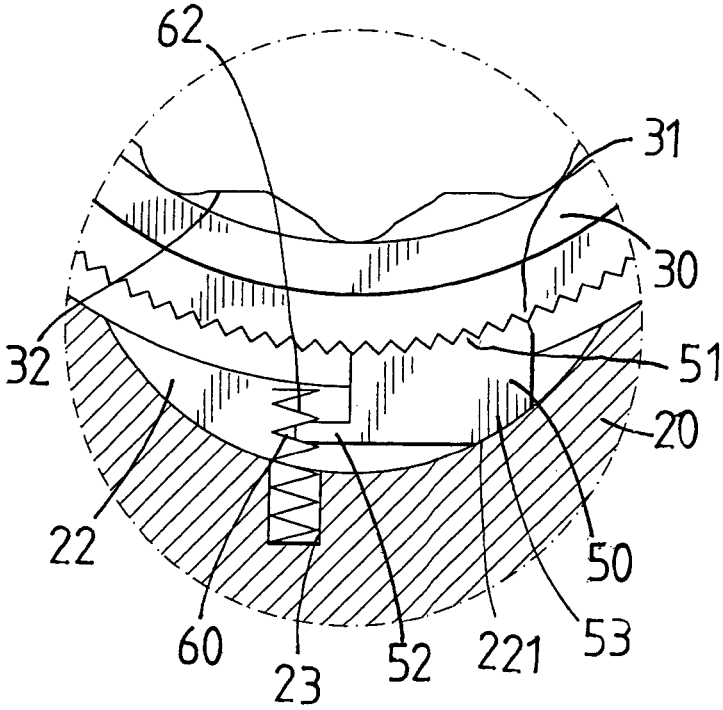
FIG. 3 is a partially enlarged view of the one-way ratchet wrench as shown in FIG. 2.

Referring to the drawings and initially to FIGS. 1–3, a one-way ratchet wrench in accordance with the preferred embodiment of the present invention comprises a wrench body 10, a ratchet wheel 30, a compression spring 60, and a pawl member 50.

The wrench body 10 has a distal end provided with a driving head 20 formed with a mounting hole 21 and a receiving recess 22 located beside and communicated with the mounting hole 21. The receiving recess 22 of the wrench body 10 has an arc-shaped wall 221 formed with a blind hole 23. Preferably, the blind hole 23 of the wrench body 10 is in parallel with a longitudinal axis of the wrench body 10.

The ratchet wheel 30 is rotatably mounted in the mounting hole 21 of the wrench body 10. The ratchet wheel 30 has an inner wall provided with a polygonal driving portion 32 and an outer wall provided with a plurality of ratchet teeth 31.

The compression spring 60 is mounted in the receiving recess 22 of the wrench body 10. Preferably, the compression spring 60 has a first end mounted in the blind hole 23 of the wrench body 10 and a second end protruding outward from the wall 221 of the receiving recess 22 of the wrench body 10. Preferably, the compression spring 60 is provided with a partition 62.

The pawl member 50 is pivotally mounted in the receiving recess 22 of the wrench body 10. The pawl member 50 has a first side provided with a plurality of driving teeth 51 meshing with the ratchet teeth 31 of the ratchet wheel 30 and a second side 53 rested on the wall 221 of the receiving recess 22 of the wrench body 10. Preferably, the second side 53 of the pawl member 50 has an arcuate shape to mate with that of the wall 221 of the receiving recess 22 of the wrench body 10. The pawl member 50 has an end provided with a locking portion 52 extended outward and secured on a side of the compression spring 60. Preferably, the locking portion 52 of the pawl member 50 is located beside the second side 53 of the pawl member 50 and located opposite to the driving teeth 51 of the pawl member 50. Preferably, the locking portion 52 of the pawl member 50 is inserted into the partition 62 of the compression spring 60, so that the locking portion 52 of the pawl member 50 is positioned on the compression spring 60.

Thus, the compression spring 60 limits transverse and longitudinal movement of the locking portion 52 of the pawl member 50, so that the pawl member 50 is positioned rigidly and stably.

Figure 4:
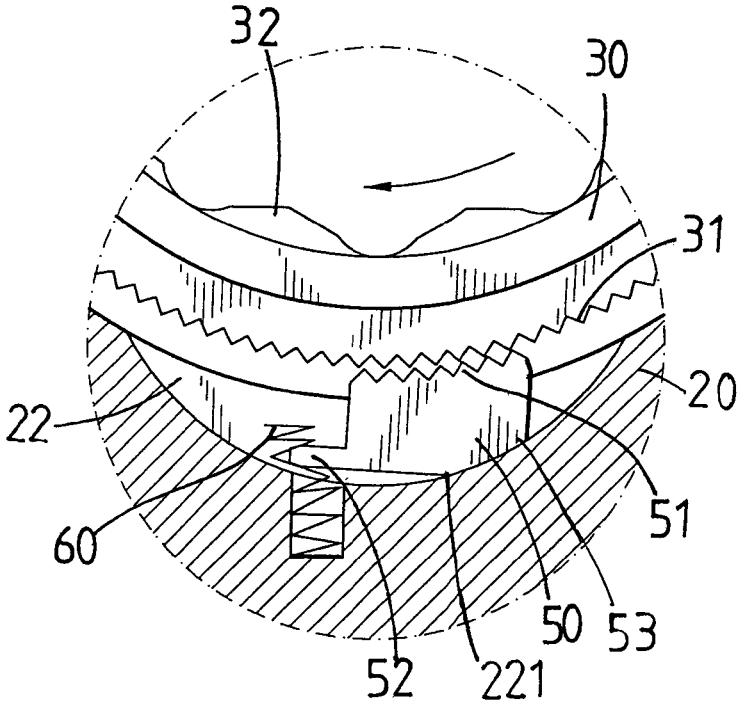
FIG. 4 is a schematic operational view of the one-way ratchet wrench as shown in FIG. 3 at an idling state.

In operation, referring to FIGS. 3 and 4 with reference to FIGS. 1 and 2, the driving teeth 51 of the pawl member 50 mesh with the ratchet teeth 31 of the ratchet wheel 30 and the second side 53 of the pawl member 50 is rested on the wall 221 of the receiving recess 22 of the wrench body 10. At this time, the locking portion 52 of the pawl member 50 is secured on a side of the compression spring 60, so that the compression spring 60 can be used to limit a transverse movement of the locking portion 52 of the pawl member 50.

Thus, when the driving head 20 of the wrench body 10 is rotated in the clockwise direction as shown in FIG. 3, the wall 221 of the receiving recess 22 of the wrench body 10 is urged on the second side 53 of the pawl member 50, so that the pawl member 50 is rotated by the driving head 20 of the wrench body 10 to rotate the ratchet wheel 30 which drives a workpiece (not shown) to rotate in the clockwise direction as shown in FIG. 3.

Alternatively, when the driving head 20 of the wrench body 10 is rotated in the counterclockwise direction as shown in FIG. 4, the second side 53 of the pawl member 50 slips on the wall 221 of the receiving recess 22 of the wrench body 10, and the pawl member 50 is driven by the ratchet wheel 30 to detach the second side 53 of the pawl member 50 from the wall 221 of the receiving recess 22 of the wrench body 10, so that rotation of the driving head 20 of the wrench body 10 idles. At this time, the pawl member 50 is moved relative to the wall 221 of the receiving recess 22 of the wrench body 10, so that the compression spring 60 is pressed by the locking portion 52 of the pawl member 50 to deflect sideward as shown in FIG. 4, thereby disengaging the driving teeth 51 of the pawl member 50 from the ratchet teeth 31 of the ratchet wheel 30. In such a manner, the compression spring 60 can be used to limit movement of the locking portion 52 of the pawl member 50 exactly.

Figure 5:
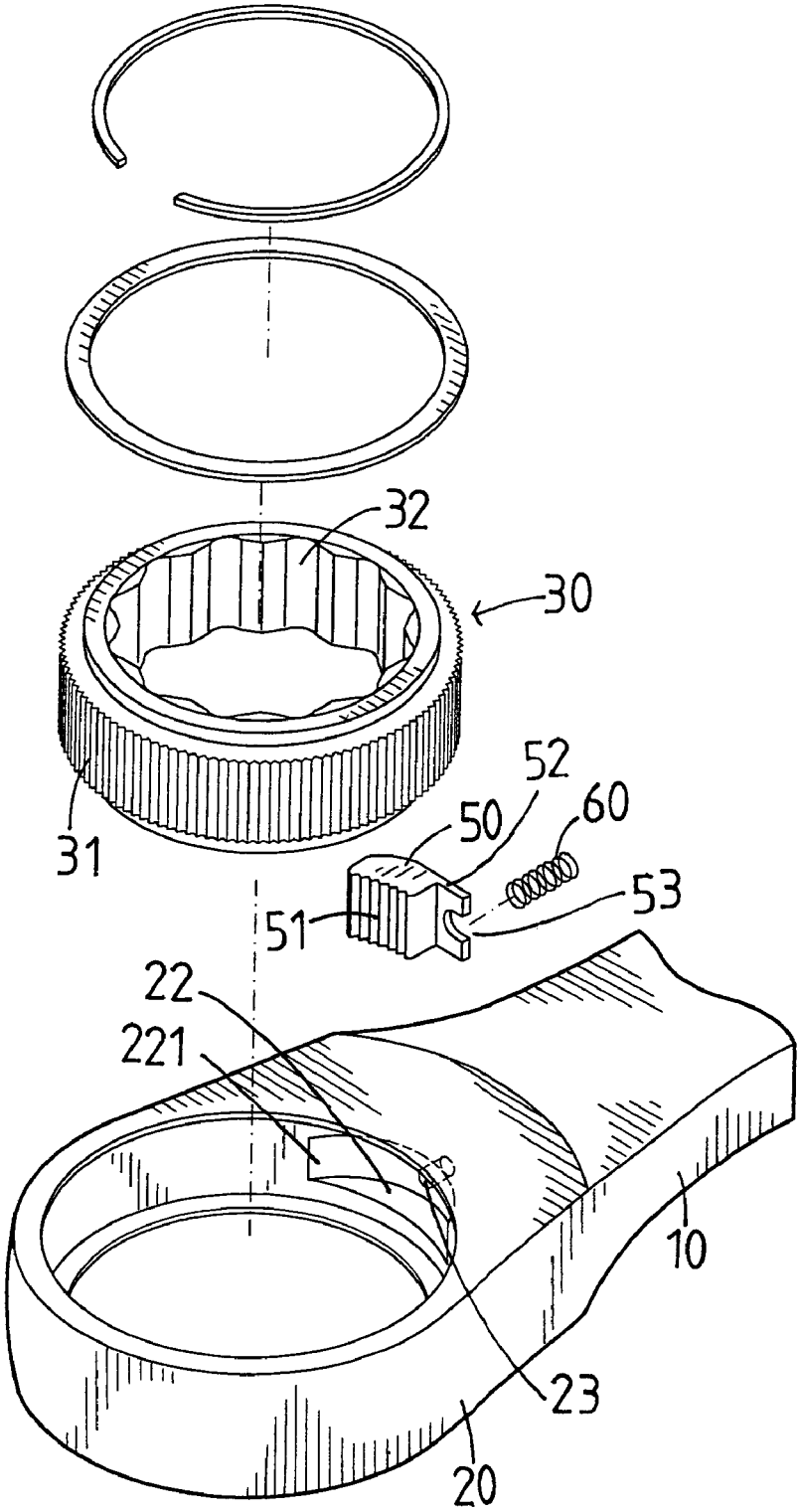
FIG. 5 is a partially cut-away exploded perspective view of a one-way ratchet wrench in accordance with another embodiment of the present invention.
Figure 6:
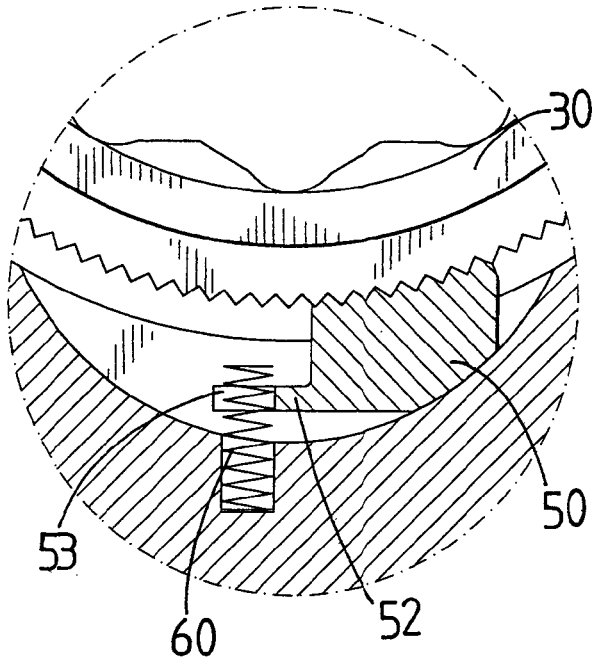
FIG. 6 is a top plan partially enlarged cross-sectional assembly view of the one-way ratchet wrench as shown in FIG. 5.
Figure 7:
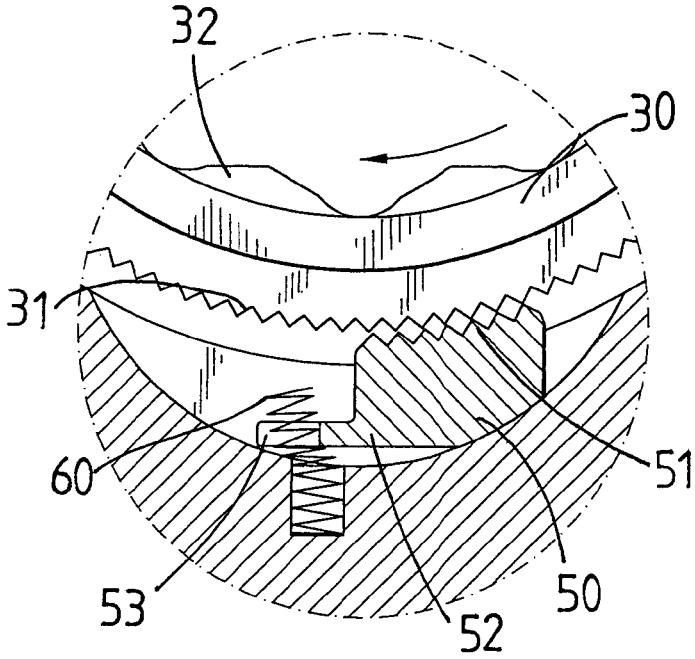
FIG. 7 is a schematic operational view of the one-way ratchet wrench as shown in FIG. 6 at an idling state.

Referring to FIGS. 5–7, the one-way ratchet wrench in accordance with another embodiment of the present invention is shown, wherein the locking portion 52 of the pawl member 50 is formed with an opening 53 to retain the compression spring 60 therein. In addition, the locking portion 52 of the pawl member 50 has a thickness is greater than a spacing distance of the compression spring 60.

Figure 8:
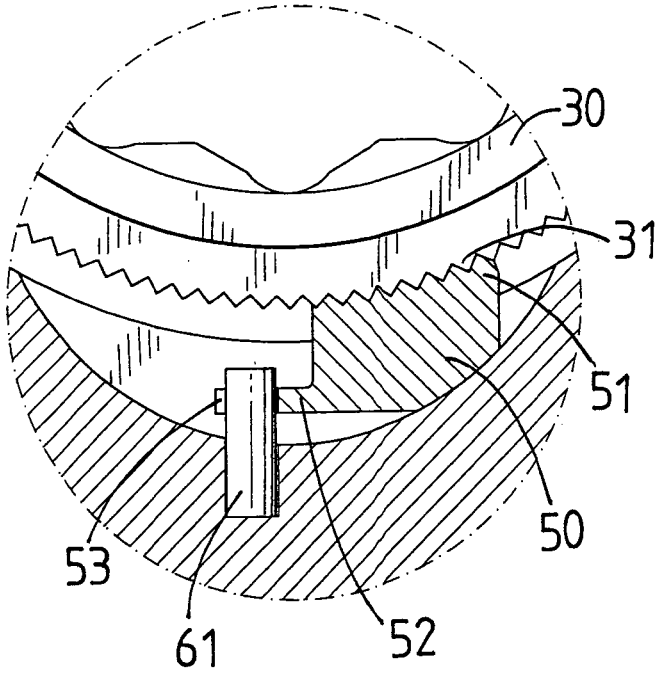
FIG. 8 is a top plan partially enlarged cross-sectional assembly view of a one-way ratchet wrench in accordance with another embodiment of the present invention.
Figure 9:
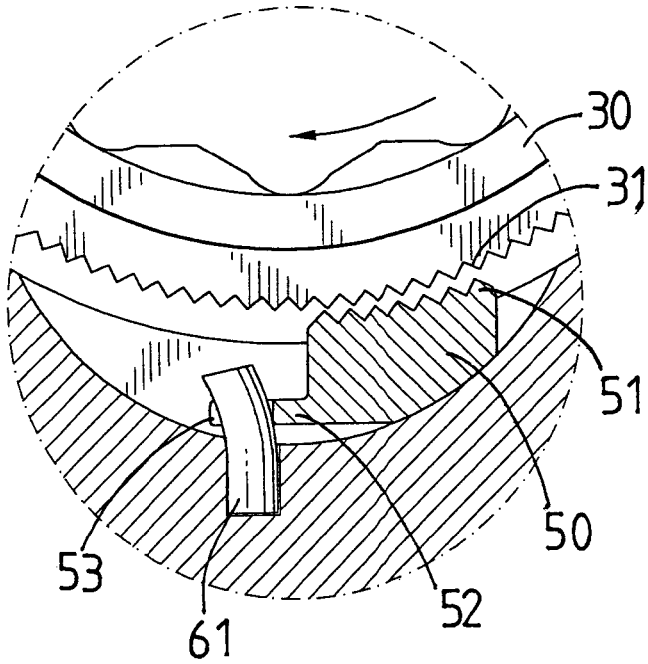
FIG. 9 is a schematic operational view of the one-way ratchet wrench as shown in FIG. 8 at an idling state.

Referring to FIGS. 8 and 9, the one-way ratchet wrench in accordance with another embodiment of the present invention is shown, wherein the compression spring 60 is replaced by an elastic bar 61 which is locked in the opening 53 of the locking portion 52 of the pawl member 50.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A one-way ratchet wrench, comprising a wrench body, a ratchet wheel, an elastic member, and a pawl member, wherein:

the wrench body has a distal end provided with a driving head formed with a mounting hole and a receiving recess, the receiving recess of the wrench body has a wall;

the ratchet wheel is rotatably mounted in the mounting hole of the wrench body;

the elastic member is mounted in the receiving recess of the wrench body;

the pawl member is pivotally mounted in the receiving recess of the wrench body and has a first side engaged with the ratchet wheel and a second side rested on the wall of the receiving recess of the wrench body; and the pawl member has an end provided with a locking portion extended outward and fixed on a side of the elastic member so that the pawl member and the elastic member are combined together.

2. The one-way ratchet wrench in accordance with claim 1, wherein the wall of the receiving recess of the wrench body is arc-shaped.

3. The one-way ratchet wrench in accordance with claim 2, wherein the second side of the pawl member has an arcuate shape to mate with that of the wall of the receiving recess of the wrench body.

4. The one-way ratchet wrench in accordance with claim 1, wherein the receiving recess is located beside and communicated with the mounting hole.

5. The one-way ratchet wrench in accordance with claim 1, wherein the wall of the receiving recess of the wrench body is formed with a blind hole, and the elastic member has a first end mounted in the blind hole of the wrench body and a second end protruding outward from the wall of the receiving recess of the wrench body.

6. The one-way ratchet wrench in accordance with claim 5, wherein the blind hole of the wrench body is in parallel with a longitudinal axis of the wrench body.

7. The one-way ratchet wrench in accordance with claim 1, wherein the locking portion of the pawl member is located beside the second side of the pawl member and located opposite to the first side of the pawl member.

8. The one-way ratchet wrench in accordance with claim 1, wherein the elastic member is provided with a partition, and the locking portion of the pawl member is a flat plate inserted into and locked in the partition of the elastic member, so that the locking portion of the pawl member is fixed on the elastic member.

9. The one-way ratchet wrench in accordance with claim 1, wherein the ratchet wheel has an outer wall provided with a plurality of ratchet teeth, and the first side of the pawl member is provided with a plurality of driving teeth meshing with the ratchet teeth of the ratchet wheel.

10. The one-way ratchet wrench in accordance with claim 1, wherein the elastic member is a compression spring.

11. The one-way ratchet wrench in accordance with claim 1, wherein the locking portion of the pawl member is formed with an arc-shaped opening facing the elastic member to retain the elastic member therein.

12. The one-way ratchet wrench in accordance with claim 11, wherein the locking portion of the pawl member is a flat plate that has a thickness greater than a spacing distance of the elastic member.

13. The one-way ratchet wrench in accordance with claim 11, wherein the elastic member is an elastic bar which is locked in the opening of the locking portion of the pawl member.

14. The one-way ratchet wrench in accordance with claim 1, wherein the elastic member is an elastic bar.

15. The one-way ratchet wrench in accordance with claim 1, wherein the locking portion of the pawl member is locked on the elastic member so that the elastic member limits longitudinal and transverse movement of the locking portion of the pawl member.

* * * * *